US012421673B2

(12) United States Patent
Benedetti

(10) Patent No.: US 12,421,673 B2
(45) Date of Patent: Sep. 23, 2025

(54) MOBILE ASPHALT RECYCLING APPARATUS AND METHOD OF USING

(71) Applicant: AMERICAN ASPHALT RECYCLING SOLUTIONS, INC., Brecksville, OH (US)

(72) Inventor: Angelo Benedetti, Brecksville, OH (US)

( * ) Notice: Subject to any disclaimer, the term of this patent is extended or adjusted under 35 U.S.C. 154(b) by 814 days.

(21) Appl. No.: 17/735,361

(22) Filed: May 3, 2022

(65) Prior Publication Data

US 2023/0357996 A1 Nov. 9, 2023

(51) Int. Cl.
*E01C 19/10* (2006.01)

(52) U.S. Cl.
CPC ..... *E01C 19/1036* (2013.01)

(58) Field of Classification Search
CPC ..... E01C 19/1036; E01C 19/104; E01C 19/1045; B01F 2101/38; B29B 7/426
See application file for complete search history.

(56) References Cited

U.S. PATENT DOCUMENTS 2,067,236 A * 1/1937 McKnight ..... E01C 19/1054 404/92
2,961,224 A * 11/1960 Wright ..... E01C 19/104 366/331
3,375,765 A * 4/1968 Hanson ..... E01C 19/15 404/101
7,152,820 B1 * 12/2006 Baker ..... E01C 19/1004 241/260.1
9,004,742 B2 * 4/2015 Burke ..... B65G 65/46 100/45
2010/0104363 A1 * 4/2010 Benedetti ..... E01C 23/065 404/113
2021/0189664 A1 * 6/2021 Sockwell ..... E01C 19/1004

FOREIGN PATENT DOCUMENTS

CN 208151812 U * 11/2018
CN 110409269 A * 11/2019 ..... E01C 23/065
WO WO-2016089748 A1 * 6/2016 ..... B01F 27/1144

* cited by examiner

*Primary Examiner* — Marc C Howell
(74) *Attorney, Agent, or Firm* — H. Jay Spiegel

(57) ABSTRACT

A mobile asphalt recycling apparatus facilitates recycling pavement to restore it to its original formula. The apparatus includes augers with transfer paddles, sizing paddles, and tumbling paddles which combine together to allow recycled materials to be thoroughly mixed and then applied on a road surface. The apparatus includes computerized aspects that permit accurate measurement of batch sizes, temperature, and other criteria. The present invention also includes a process which utilizes the apparatus. The process includes sampling and testing the existing pavement, restoring it to the original criteria, and facilitating repaving.

20 Claims, 17 Drawing Sheets

QUAD SHAFT

TWIN SHAFT

MOBILE ASPHALT RECYCLING APPARATUS AND METHOD OF USING

BACKGROUND OF THE INVENTION

The National Asphalt Paving Association (NAPA) reports that there are over 2.6 million miles of paved roads in the United States and over 94% of them are surfaced with asphalt. Asphalt pavement material is a combination of approximately 95% stone, sand, or gravel bound together by asphalt cement.

Asphalt cement is mainly a mixture of asphaltene and maltenes. Asphaltenes are molecular substances that are found in crude oil along with resins, aromatic hydrocarbons, and saturates. Asphaltenes are mainly composed of carbon, hydrogen, nitrogen, oxygen, and sulfur as well as trace amounts of vanadium and nickel.

Maltenes are the n-alkane-soluble molecular components of asphalt and consist of heavy, dark-colored asphaltic resins, first acidaffins, second acidaffins, and saturates combined with lighter colored oils. The resins in maltenes provide the adhesive qualities in asphalt. The oils are the carrier medium for both maltene resins and asphaltene compounds. Maltenes have a lower molecular weight than asphaltenes. Asphaltenes provide strength while maltenes hold the asphaltenes in a fluid state to provide flexibility.

When it is desired to pave a road surface with asphalt, the formula that is chosen to do so is variable. The variations include the sizes of the aggregate in the mix as well as the ratio of asphaltenes to maltenes. Aggregate is defined at the smaller sizes by the numbers 4 to 200. The meaning of these numbers is the number of openings per square inch in a sieve used to determine the percentages of each size of the aggregate. In order to do so, a plurality of sieves having differing sized openings are stacked above one another with the sieves near the top having the largest sized openings. An aggregate mixture is placed above the top sieve and the sieves are subjected to vibration causing the mixture to flow through the sieves with each level with a sieve of increasingly smaller openings capturing the aggregate that cannot pass through its openings. When this process is completed, it is possible to determine the percentage by weight or volume of the differing sized pieces of aggregate within the mixture. The preferred variations are determined by analysis of several factors including the climate in the area where the paving is to take place as well as the anticipated load of vehicles that will be traversing the road surface. Such factors as temperature range, humidity range, and average precipitation play a role in determining the specific formula of asphalt that is employed in any geographical area.

When considering a formula for creating the aggregate component of an asphalt mixture, the aggregate can range in size from 75 μm (corresponding to 200 openings/square inch on a sieve) up to 1½ inch diameter and perhaps greater. Where the pavement will be supporting larger loads, for example, in an interstate highway, the aggregate mixture has a higher percentage of larger aggregate. Where the load is lighter, the smaller aggregate can take on a higher percentage of the load.

Over time, there comes a need for an asphalt pavement to be repaired or replaced. Signs that this may be the case include observed brittleness of the pavement, cracks in the pavement, and even formation of potholes. Cracks and potholes often become formed due to freeze and thaw cycles of water entering small voids in the pavement. As is well known, when ice melts, it expands. This phenomenon causes water that has turned to ice and then thaws to expand voids in pavement creating such cracks and potholes.

The brittleness of pavement, caused over time, results from a breakdown of the chemical formula for the asphalt itself. Typically, the maltenes in the pavement tend to slowly dissipate with the result being that the pavement becomes brittle and more susceptible to damage such as formation of cracks and potholes.

The industry of repairing and replacing asphalt pavement is a huge industry in the United States. Tens of billions of dollars are spent annually maintaining asphalt pavement surfaces. Several different techniques are employed.

The most drastic technique employed is to remove existing asphalt pavement, discard it, and replace it with new asphalt pavement. This technique fails to make use of the existing asphalt pavement material and is quite cost prohibitive. A second technique that is employed is merely to "rejuvenate" the existing pavement without removing it or replacing it. Asphalt rejuvenators typically consist of the maltenes that have been removed from the asphalt pavement through the passage of time. Where the attempt is made to replace the maltenes by merely applying them onto the pavement surface, the maltenes penetrate down into the top layer of pavement but may not penetrate sufficiently deeply enough to comprise an effective rejuvenation.

Additionally, during the course of the life of an asphalt pavement, periodic repairs of cracks and potholes are necessarily performed, usually by municipalities. Such repairs are basically a "bandaid" and do not address the systematic problems occurring in the pavement due to age and departure of the maltenes that maintain the pavement strong and flexible.

Some repairs and maintenance of pavement use a sealer coated over the surface of an existing pavement. This may give the pavement the "look" of a healthy pavement but, in truth, merely applying a sealer just hides the systematic deterioration of the underlying asphalt.

With recent increases in the costs of petroleum, given the fact that the constituent ingredients of asphalt include components of petroleum, it is that much more imperative that a cost effective and efficient apparatus and method be employed in repaving an asphalt road surface. The most cost effective and structurally effective technique for rejuvenating an asphalt pavement consists of removing the pavement, restoring the aggregate-asphaltene-maltene formula that was originally paved onto the road surface, and then repaving the surface with the so rejuvenated asphalt pavement. While this is the most cost effective and structurally effective technique to employ, to date, asphalt repaving vendors have not been able to perfect a process that will result in complete restoration of the pavement to its previous original form. In these present days of economic stress, inflation, and economic uncertainties, it would be advantageous to provide an apparatus and method facilitating recycling of existing pavement to restore it to its original form in a high quality, cost effective manner. It is with this goal in mind that the present invention was developed.

Applicant is aware of U.S. Pat. No. 10,337,154 to Baumrind which discloses and claims an asphalt recycler device. As will be evident in the disclosure to follow, the apparatus of the present invention distinctly differs from the teachings of Baumrind as contemplating an apparatus that more effectively heats a mixture, mixes the mixture, and dispenses it onto a road surface.

The present invention provides a revolutionary improvement over repaving systems and devices currently known. It provides a scientific approach to repaving and enhances accuracy of restoration of asphalt paving material so that, unlike any previous systems, the repaved material more closely matches the formula of the material originally paved.

The comparison between the present apparatus and process and the prior art is dramatic. Among others, the following differences are noteworthy:

1. In the prior art, diesel fuel is employed to fuel heaters that heat the repaving material, or when propane fuel is employed there is no use of a blower to provide combustion air. Prior art devices are environmentally unfriendly at best, creating significant air pollution. In prior art designs where diesel fuel is employed, it is accurate to characterize those heaters as a diesel-fired blow torch. By contrast, in the present invention, propane fueled radiant/convection heaters are employed with a blower forcing air into the chamber to enhance efficiency as well as uniformly distribute the heat throughout the chamber. Applicant has found that the heating system employed in the present invention is multiple times more efficient in fuel usage and heat transfer as compared to the prior art.
2. In the prior art, the typical manner by which the paving material is mixed is similar to a commonly seen cement mixer with a large revolving drum tumbling the material in a single direction. The prior art fails to contemplate any structure to size the paving material or knead it. By contrast, in the present invention, augers are provided that include transfer paddles to transfer the material from one subchamber to another, sizing paddles which break up multiple aggregate pieces, and tumbling paddles which push the paving material into and out of the upper reaches of the subchambers which contain the augers to better facilitate thorough mixing.
3. The prior art fails to contemplate ensuring that the paving material does not include large chunks of material made up of plural pieces of aggregate bound together with asphaltenes and maltenes. Such large chunks of material are commonly seen when observing prior art repaving devices. When such large chunks exist, they result in uneven paving and loss of durability. By contrast, the present invention includes augers with sizing paddles that break up such chunks so that individual aggregate pieces exist to ensure smooth paving and correct laydown.
4. In the prior art, pavement recycling processes may include addition of emulsified asphalt to a batch of paving material prior to processing to strengthen the mix. However, no attention is given to trying to restore the paving material to be recycled to the formula it possessed when the original paving occurred. As explained hereinafter, the formula for a paving material including the sizes of the aggregate and the mix of asphaltenes and maltenes is devised for each geographical area based upon both climate conditions and the anticipated vehicle load. Applicant's apparatus and process ensure that the repaving material closely matches the original formula.
5. In the prior art, there is little testing of the existing pavement to determine its properties and compare them to the properties of the original formula. As explained hereinafter, one characteristic of worn pavement is the deterioration of the maltene component which results in cracking as well as formation of potholes. By contrast with the prior art, in the present invention, samples of the existing pavement are removed and tested to determine the current formula and that formula is compared to the original formula. Thereafter, the original formula is restored to the paving material before it is paved onto the road surface.
6. In the prior art, it is rare that a contractor is aware of the weight of each batch of paving material that is being processed. By contrast, in the present invention, the weight of a batch from about ½ ton to up to 3 tons is accurately measured. This measurement best facilitates how to control the burners and the temperature inside the mixing chamber as well as how much additive such as rejuvenating chemical and/or fresh asphalt cement must be added to a batch to facilitate restoration of the paving material formula.
7. In the prior art, there is no accurate temperature measurement within the mixing chamber. Rather, in the prior art, contractors often guess as to the temperature by monitoring the color of the smoke emanating from the exhaust pipe of their highly polluting devices. By contrast, in the present invention, close monitoring of temperature is conducted within the mixing chamber so that the contractor will know the status of temperature therein.
8. Contrasting with the prior art, the present invention will give the user a choice of mix designs to choose from and further choices for the condition of the mixed existing repaving material with the goal of providing the highest quality recycled hot mix asphalt pavement.

SUMMARY OF THE INVENTION

The present invention relates to a mobile asphalt recycling apparatus and method of using. The present invention includes the following interrelated objects, aspects, and features:

(1) The practice of the present invention begins by performing a detailed analysis of the existing pavement which is to be recycled. This is done in accordance with the teachings of the present invention by removing approximately 12"×12" slabs from the actual pavement itself. These pieces are subjected to a laboratory analysis process to determine their precise specifications. Preferably, all of the samples obtained from differing locations in the entire pavement surface in question are heated and dislodged and then combined together into a single homogeneous mix.

(2) The batch is then preferably divided up into three separate sub-batches. One sub-batch is kept as is as a baseline for testing, a second sub-batch is mixed with, for example, 0.3% of a rejuvenator chemical such as one that includes restoring maltenes, and a third such sub-batch is mixed with 0.6%, for example, of the same rejuvenator.

(3) Next, the stability and flow of all three sub-batches are tested and compared with what would be expected for the stability and flow of an asphalt pavement having the original specifications of the pavement when it was originally installed.

(4) A chart is prepared in which all the criteria of each of the three sub-batches are plotted including the percentages of each aggregate size asphalt cement % content stability and flow Marshall testing. Marshall testing is known to those skilled in the art.

(5) After this testing is done, it is quite possible that neither of the second or third sub-batches has the appropriate specifications to be an example of how the pavement should be rejuvenated and reinstalled. By graphing the various criteria and appropriately extrapolating, the proper proportion of rejuvenator can be determined. Once this occurs, that proportion of rejuvenator is added to the first sub-batch and it is tested to determine whether the specifications substantially match the original road specifications. If this is the case, the proper formula for repaving has been determined. If not, additional samples of the existing pavement must be taken and the testing is redone.

(6) Once the formula for the pavement has been determined, the present invention also contemplates an apparatus for recycling the pavement. That apparatus includes the following aspects and features:

(7) The inventive apparatus includes various components mounted on a wheeled trailer and able to be towed behind a truck such as a dump truck. The device includes efficient means for heating a batch of asphalt material that is going to be applied on a road surface.

(8) The means for heating the asphalt material includes a furnace providing radiant and convection heating fueled by propane gas along with one or more blowers to blow into the heating area combustion air to enhance the efficiency of heating. An exhaust pipe is provided to facilitate exhausting of exhaust gases formed through the heating process.

(9) Another unique feature of the inventive apparatus consists of the structure and functions of its mixing augers. In accordance with the teachings of the present invention, the mixing augers are provided in either one or two pairs. These augers are designed with transfer paddles, sizing paddles, and tumbling paddles which allow the asphalt material to travel in one direction along an auger and then be transferred to an adjacent auger to travel in the opposite direction until getting to the end of the other auger whereupon transfer paddles transfer the asphalt material to the first-mentioned auger. Where four augers are employed, they are employed as two pairs performing the functions described above. As such, the asphalt material is thoroughly mixed as it travels around and around from one auger to the next auger and then back and forth as the furnace heats the asphalt material.

(10) After several minutes of auguring the asphalt mixture which is maintained at the desired temperature, the asphalt material is ready to be dispensed onto the road surface and then contoured and flattened to create the road surface.

(11) In the preferred embodiment of the present invention, the apparatus described above is sized so that it can heat, mix, and dispense asphalt material in batches of in the range of one-half to three tons of material. Thus, at least a half ton or so of material is placed within the auguring chamber, is heated, and mixed by operation of the augers, and dispensed, and thereafter, another half ton or so of material is added and the process is repeated.

(12) In accordance with the teachings of the present invention, in a manner never before accomplished in the asphalt pavement repaving industry, an existing pavement can be tested, removed, rejuvenated, and reinstalled to the same specifications as was the case when it was originally installed years before.

As such, it is a first object of the present invention to provide a mobile asphalt recycling apparatus and method of using.

It is a further object of the present invention to provide such an apparatus and method in which existing pavement is tested, removed, rejuvenated, and reinstalled.

It is a still further object of the present invention to provide such an apparatus and method in which the rejuvenated pavement material is mixed in a manner not before contemplated in the prior art to assure that the specifications are uniform throughout the mixture.

It is a yet further object of the present invention to provide such an apparatus and method in which laboratory analysis is performed on the existing pavement to determine in what respects the existing pavement is not exhibiting the original specifications when it was originally installed, and then those specifications are restored.

It is a still further object of the present invention to provide such an apparatus and method in which the removed pavement can be repaved onto the road surface in batches of one half ton or more.

These and other objects, aspects and features of the present invention will be better understood from the following detailed description of the preferred embodiment when read in conjunction with the appended drawing figures.

SPECIFIC DESCRIPTION OF THE PREFERRED EMBODIMENTS

Figure 1:
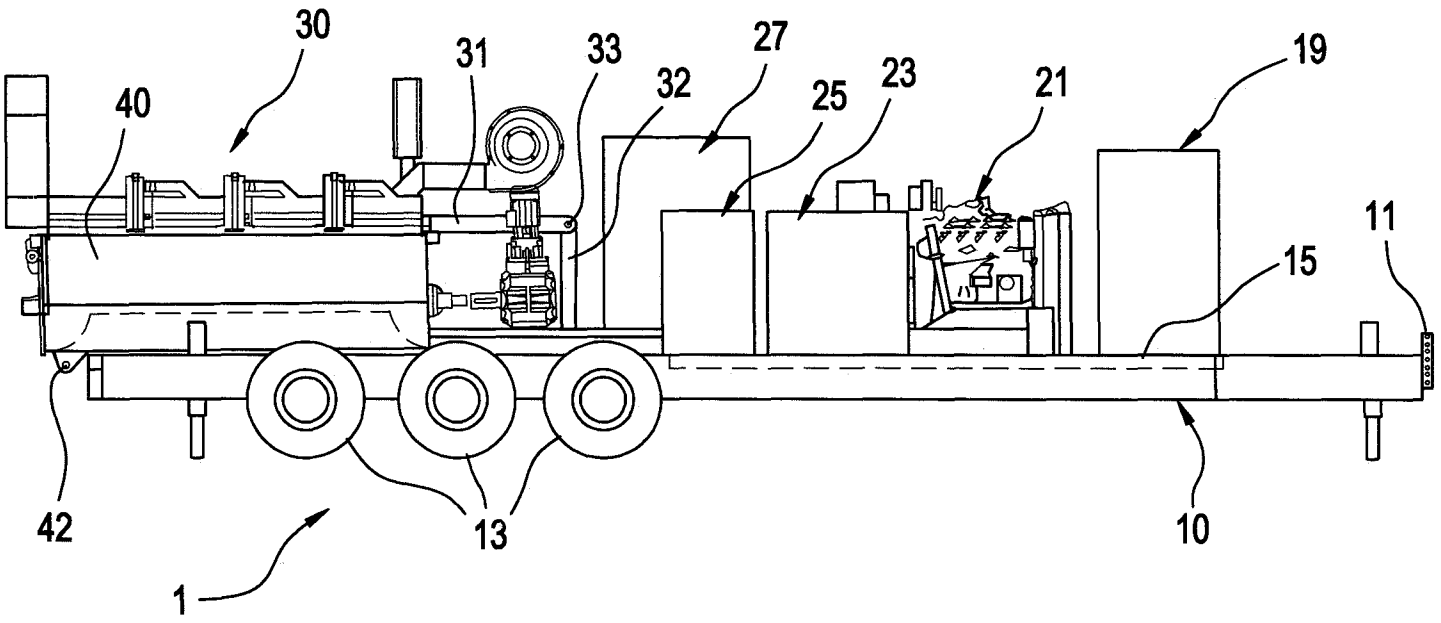
FIG. 1 shows a side view of the mobile asphalt recycling apparatus of the present invention.
Figure 2:
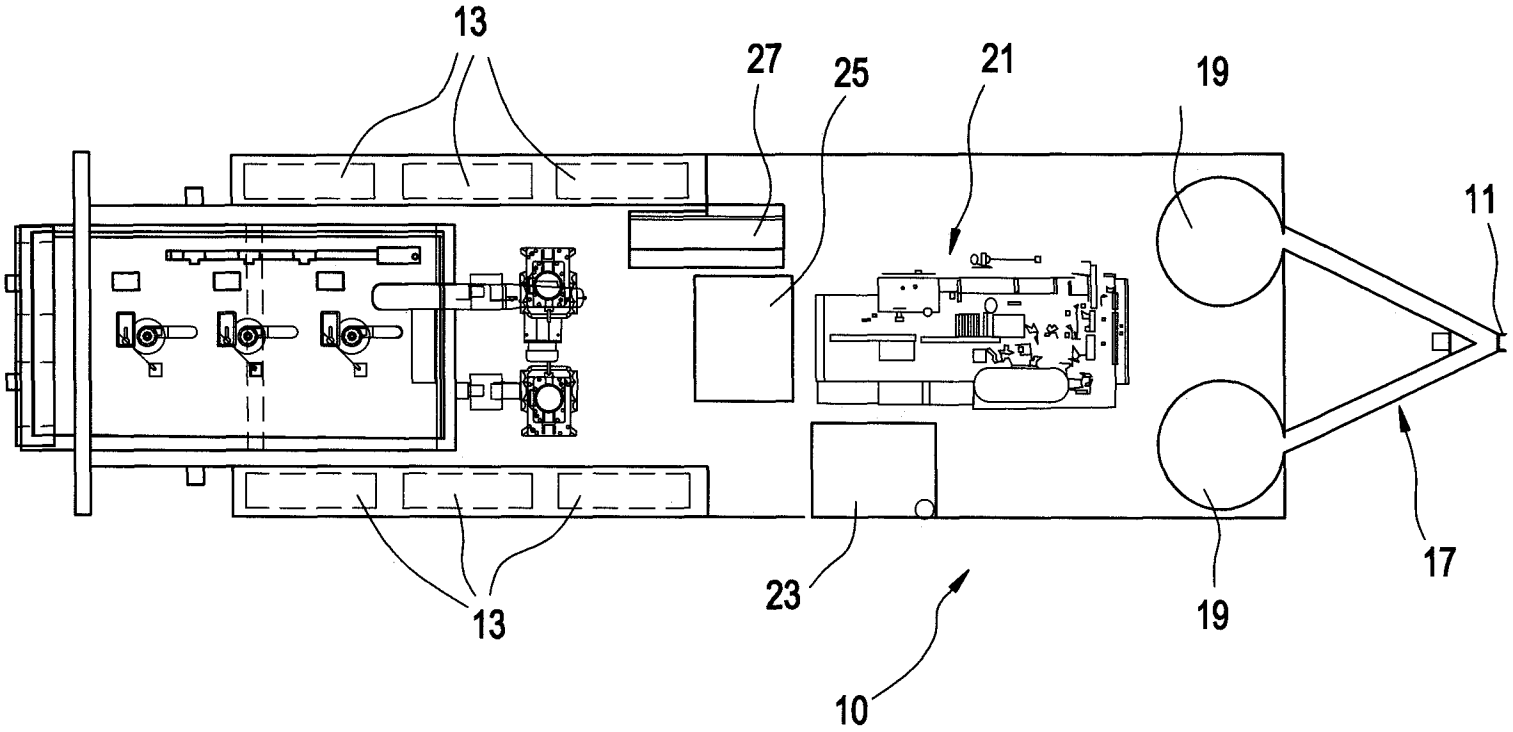
FIG. 2 shows a top view of the inventive apparatus.

With reference, first, to FIGS. 1-4, the inventive apparatus in accordance with the teachings of the present invention is generally designated by the reference numeral 1 and is seen to include a housing comprising a trailer 10 having a hitch 11, support tires 13, and a top surface 15 which supports the components of the inventive apparatus 1. As shown in FIG. 2, in the preferred embodiment, there are three tires on each side of the trailer 10.

The hitch 11 is coupled to the remaining structure of the trailer 10 by a V-shaped support 17 best seen in FIG. 2.

Mounted on the platform 15 are the various components of the apparatus 1 including propane storage tanks 19, a propane powered electrical generator 21, a primary asphalt rejuvenator storage tank 23, an asphalt cement emulsion tank 25, and an electrical control panel 27. Hydraulically powered controls can also be employed if desired. In the preferred embodiment, the tanks 23 and 25 each have a storage capacity of about 100 gallons.

Figure 13:
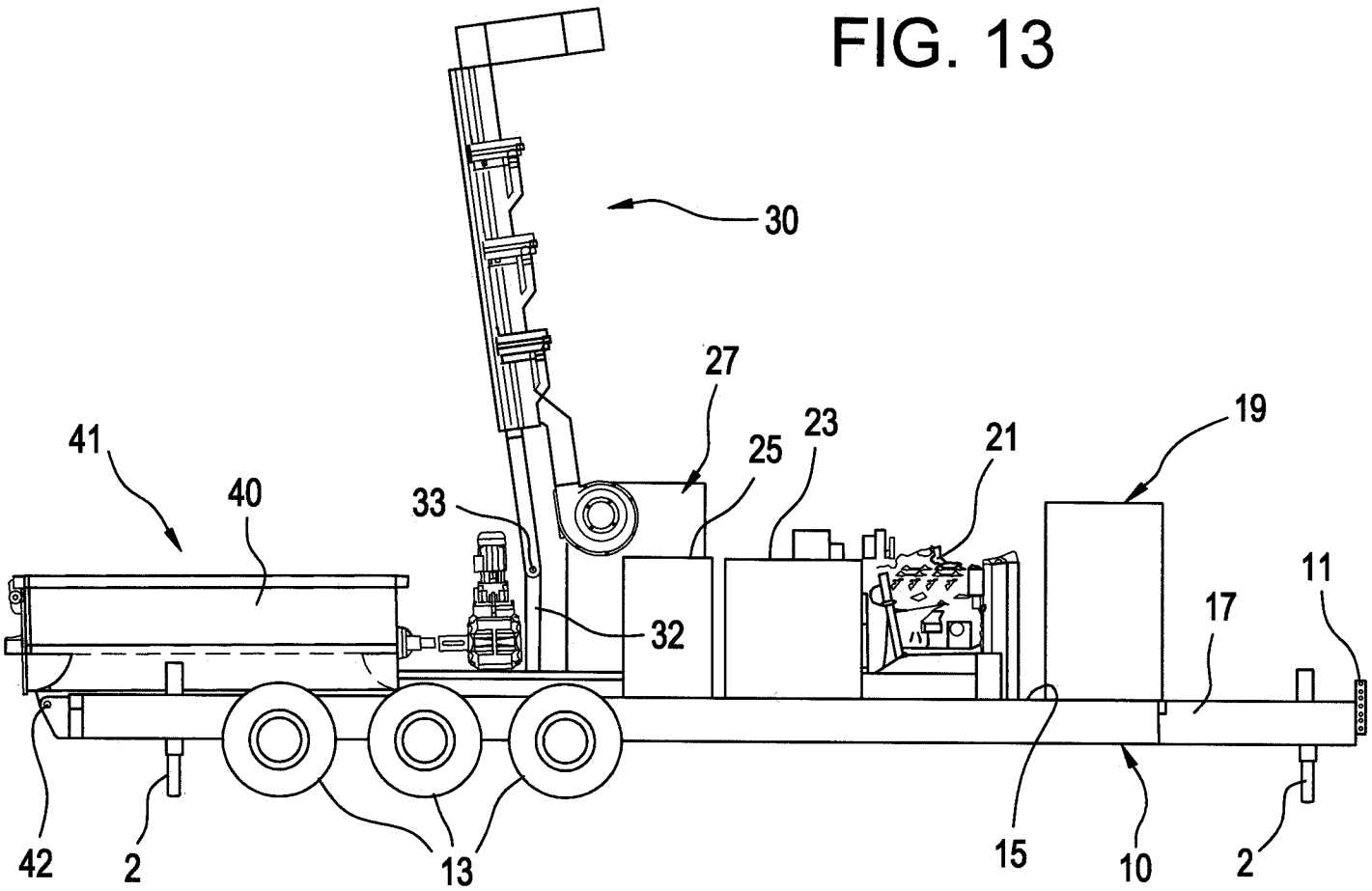
FIG. 13 shows a side view of the apparatus similar to FIG. 1 but with the furnace pivoted upwardly to expose an upper opening of the recycling chamber to facilitate filling the recycling chamber with asphalt to be recycled.
Figure 14:
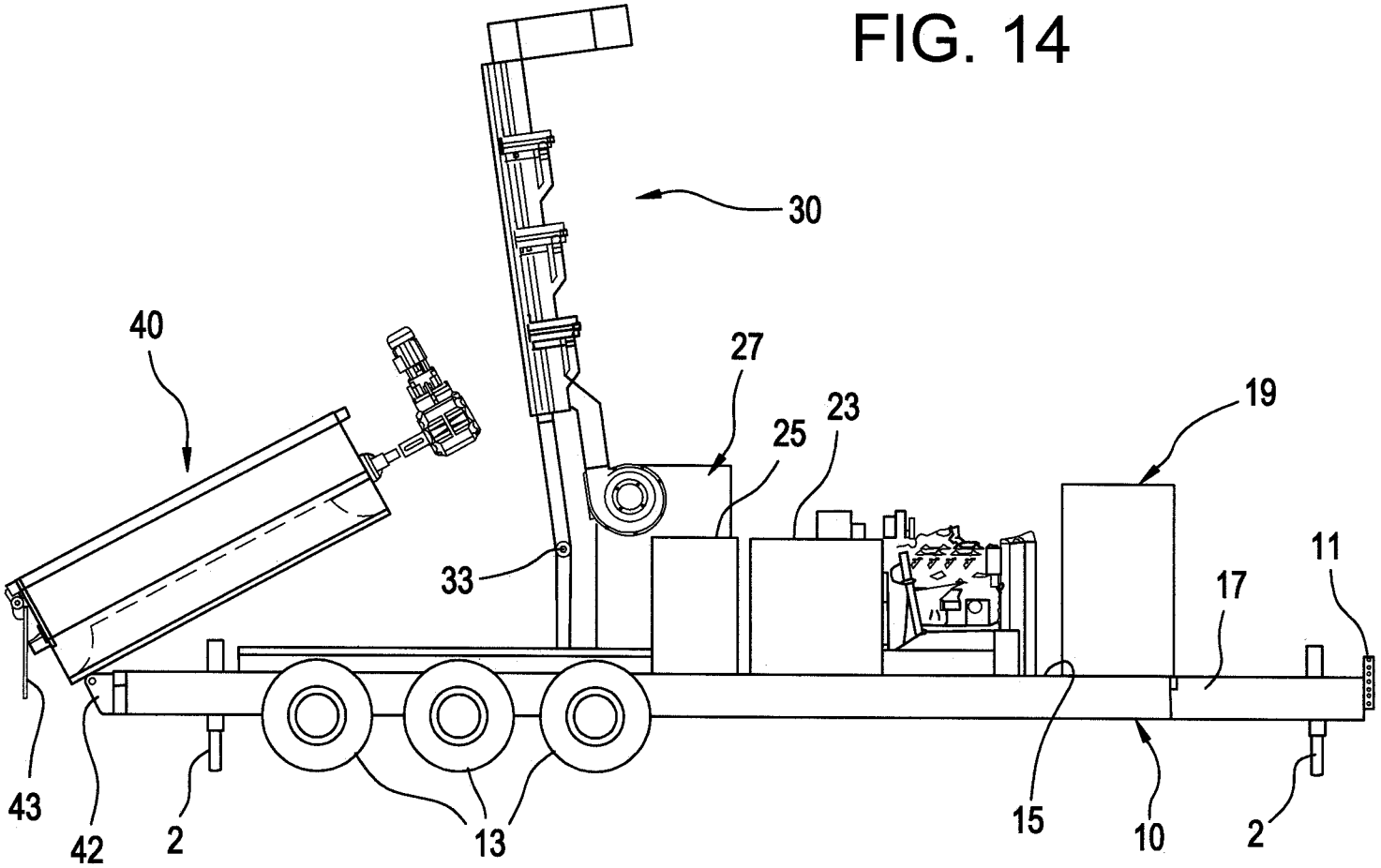
FIG. 14 shows a side view of the apparatus similar to that of FIG. 1 showing the furnace elevated and the recycling chamber pivoted to allow dumping of a mixed load of recycled asphalt to be dumped onto a roadway surface.

To the rear of the trailer 10, a radiant convection furnace 30 is mounted above a recycling chamber 40. The furnace 30 is mounted with a frame 31 and a pivot 33 at the top of a support 32 which allows the entire furnace 30 to pivot upwardly as shown in FIG. 14 when it is desired to load a quantity of to be recycled asphalt within the recycling chamber 40. As shown in FIG. 13, the furnace 30 is also pivoted upwardly so that an upper opening 41 of the recycling chamber 40 can be exposed to allow the recycling chamber 40 to be filled with paving material such as asphalt to be recycled.

As also seen in FIG. 14, the recycling chamber 40 has a tailgate 43 which can be unlocked and allowed to pivot to the open position shown in FIG. 14 when the recycling chamber 40 is pivoted about the pivot 42 to permit dumping of treated recycled asphalt onto a road surface during a repaving procedure. The dumping occurs at the end of a mixing cycle, and the augers discharge—one auger reverses direction to controllably push the material out the rear first, then dumping is employed to clean crumbs out for the next batch. This has been found to be an efficient way to dump a mixed batch and empty and clean out the subchambers 50 shown in FIGS. 3, 7 and 8. The angle of pivoting of the augers on discharge in recycling chamber 40 controls the rate of dumping of a load of treated recycled asphalt and can be adjusted as necessary in precise degrees.

Figure 3:
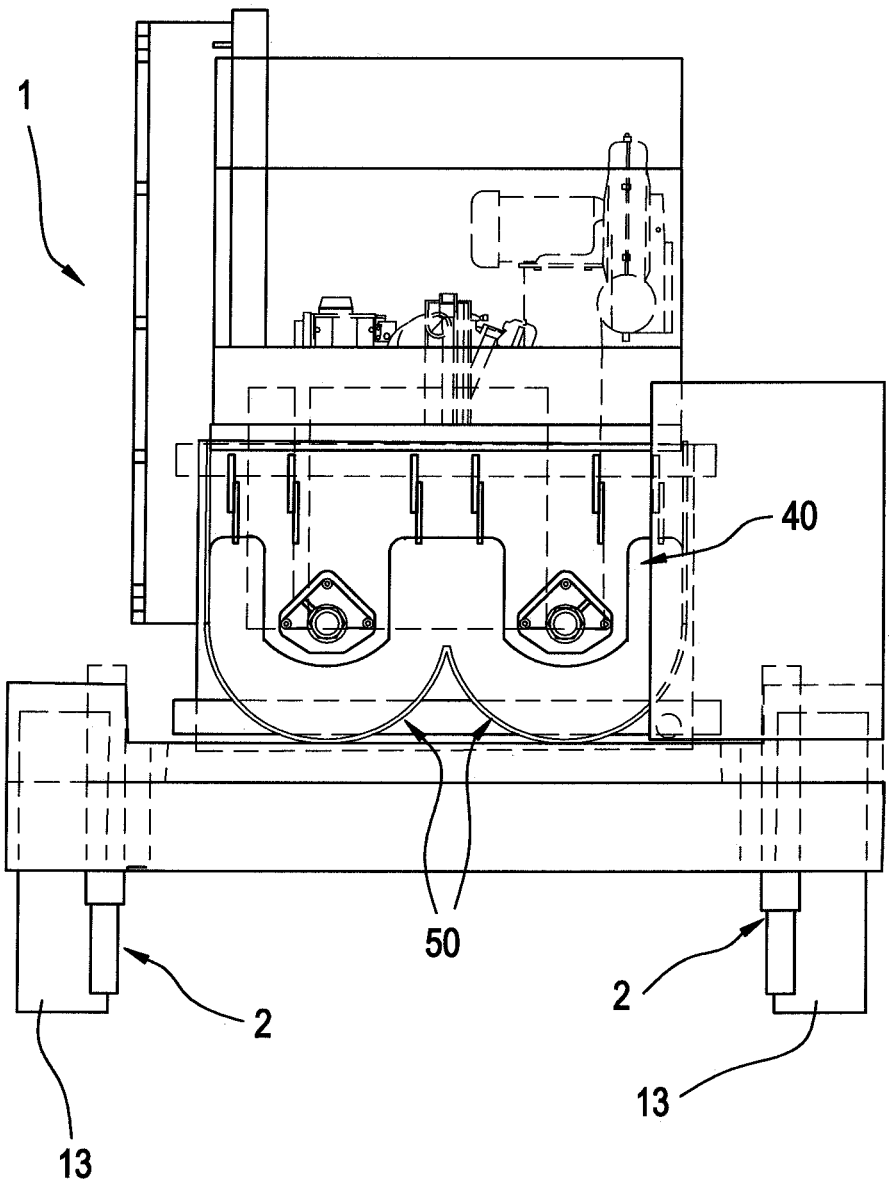
FIG. 3 shows a rear view of the apparatus.

As shown in FIG. 3, when the apparatus 10 is located at a desired location, jacks 2 may be extended in a manner well known to those skilled in the art to take the load off the tires 13 and support the apparatus 1 in a fixed location. When this occurs, weight is transferred to load cells allowing the apparatus to determine the weight of each batch. FIG. 3 also shows the lower configuration of one embodiment of the recycling chamber 40 which is seen to include the two part circular cross-section subchambers 50. Within these subchambers augers are provided which will be explained in greater detail hereinafter.

Figure 4:
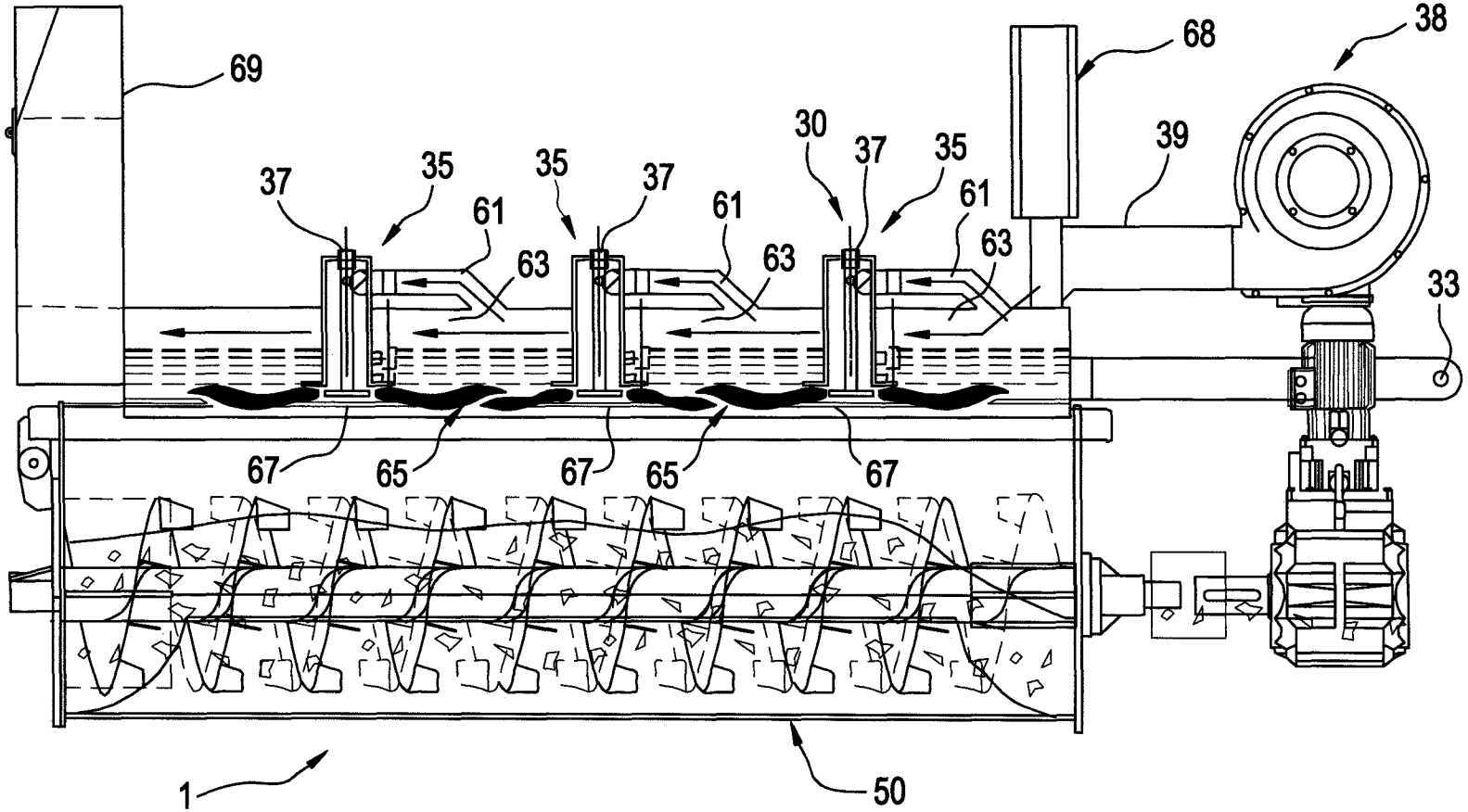
FIG. 4 shows an enlarged view of the recycling chamber and furnace of the present invention.

With reference to FIG. 4, the radiant convection furnace 30 is made up of radiant heaters with excess air allowing them to burn cleanly and provide convection and is provided with an air flow pattern that entrains pollutants and incinerates them as it heats the recycling material.

As shown in FIG. 4, the furnace 30 includes, for example, three burners 35, each of which includes a central tube 37 which receives propane gas from the fuel supply storage tanks 19 via conduits which are omitted to better show details. A combustion air blower 38 supplies air through a conduit 39 to passageways 61 and 63. The propane is ignited in a manner well known to those skilled in the art causing flames 65 to be emitted from the nozzles 67. The size of the openings of the nozzles 67 is controllable in a manner well known to those skilled in the art to control the size of the flame, the volume of propane gas supplied and thereby the temperature created at the location of the subchambers 50.

Flame safety controllers 68 control the size of the flames 65 by controlling the size of the nozzles 67 as well understood. An exhaust flue 69 exhausts gases formed by combustion. The structure of the furnace 30 facilitates entraining an incineration of pollutants to reduce air pollution in the operation of the device 1.

Figure 5:
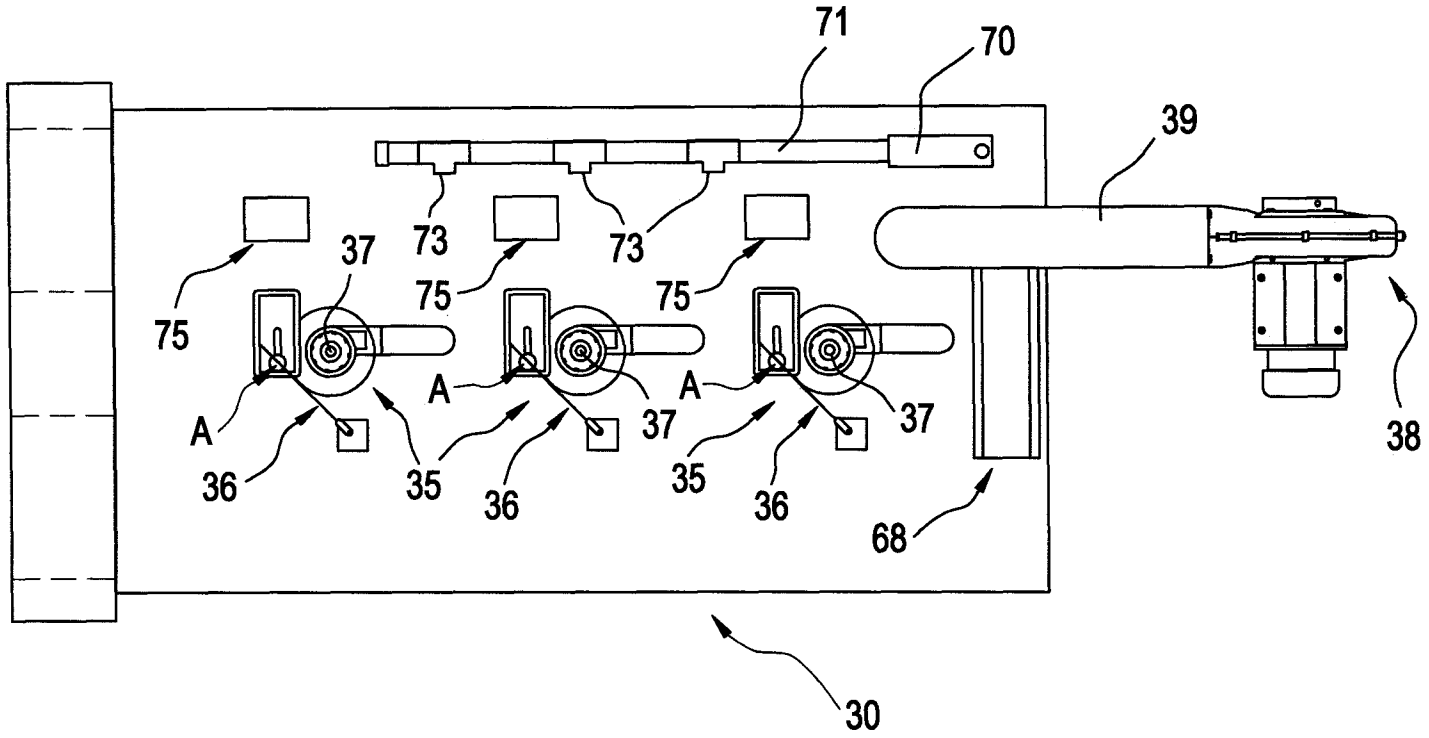
FIG. 5 shows a top view of an embodiment of the furnace in which twin augers are included.
Figure 6:
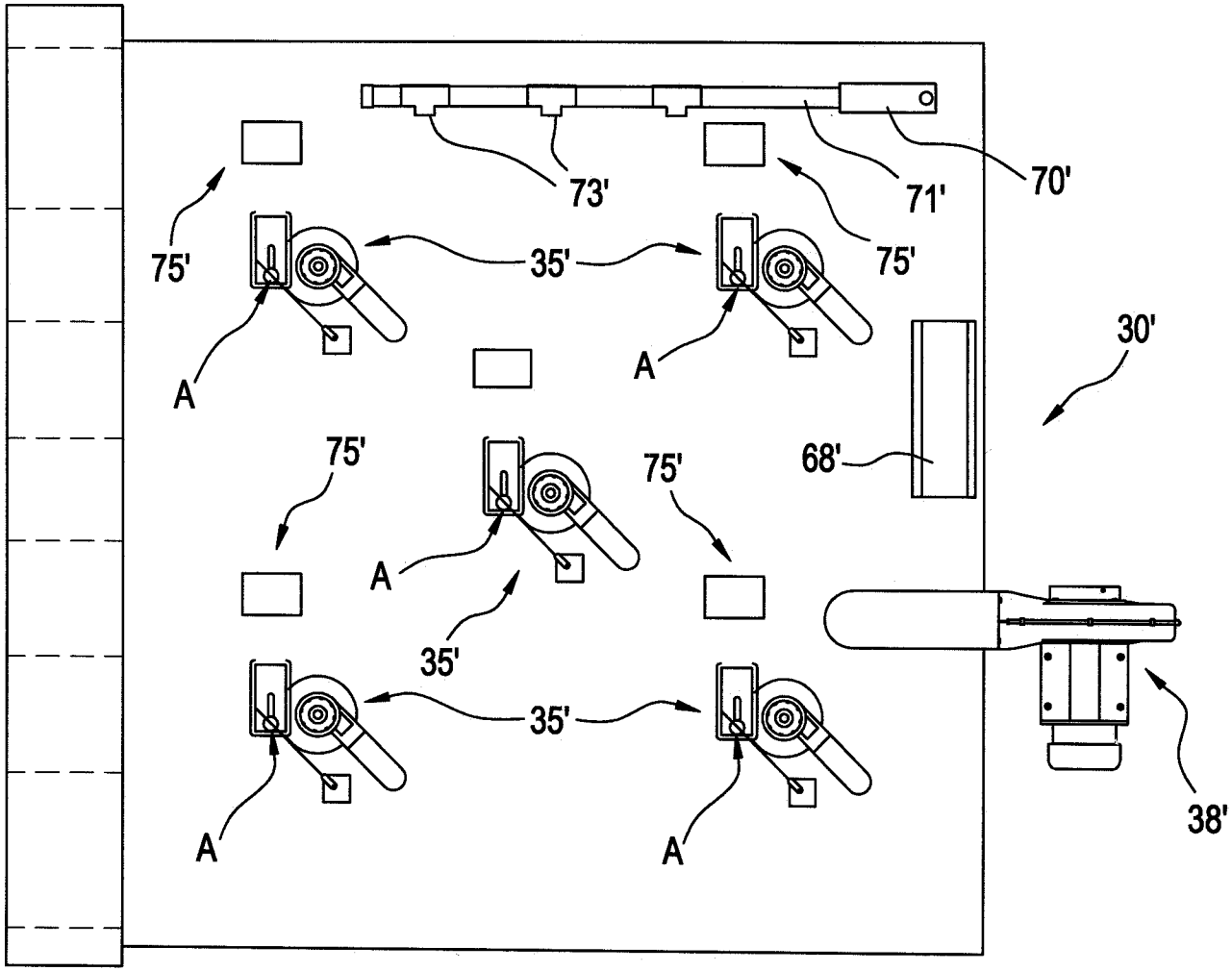
FIG. 6 shows a top view of the furnace in which quadruple augers are included.

With reference to FIGS. 5 and 6, two variations of the furnace may be provided. FIG. 5 shows the embodiment of furnace 30 in which there are two augers as will be described in greater detail hereinafter. As shown in FIG. 5, with reference also to FIG. 4, the furnace 30 includes the combustion air blower 38, conduit 39, burners 35, flame rods 36 (not shown in FIG. 4), propane supply conduits 37, and the other components shown in FIG. 4.

Additionally, FIG. 5 shows the pilot mixer 70 with a conduit 71 with outlets 73 that supply the pilots A (FIGS. 5 and 6). Ignition transformers 75 facilitate igniting the pilots (A) that ignite the burners 35 shown in FIGS. 5 and 6 when they are supplied with propane gas from the storage tanks 19 (FIG. 2). With reference to FIG. 6, the furnace 30' is similar to the furnace 30 but has additional burners to provide heat to four subchambers 50 in which augers are provided as will be described hereinafter. Structures in FIG. 6 analogous to those in FIG. 5 are described using like primed reference numerals. As such, the operation of the furnace 30' is self-evident.

Figure 7:
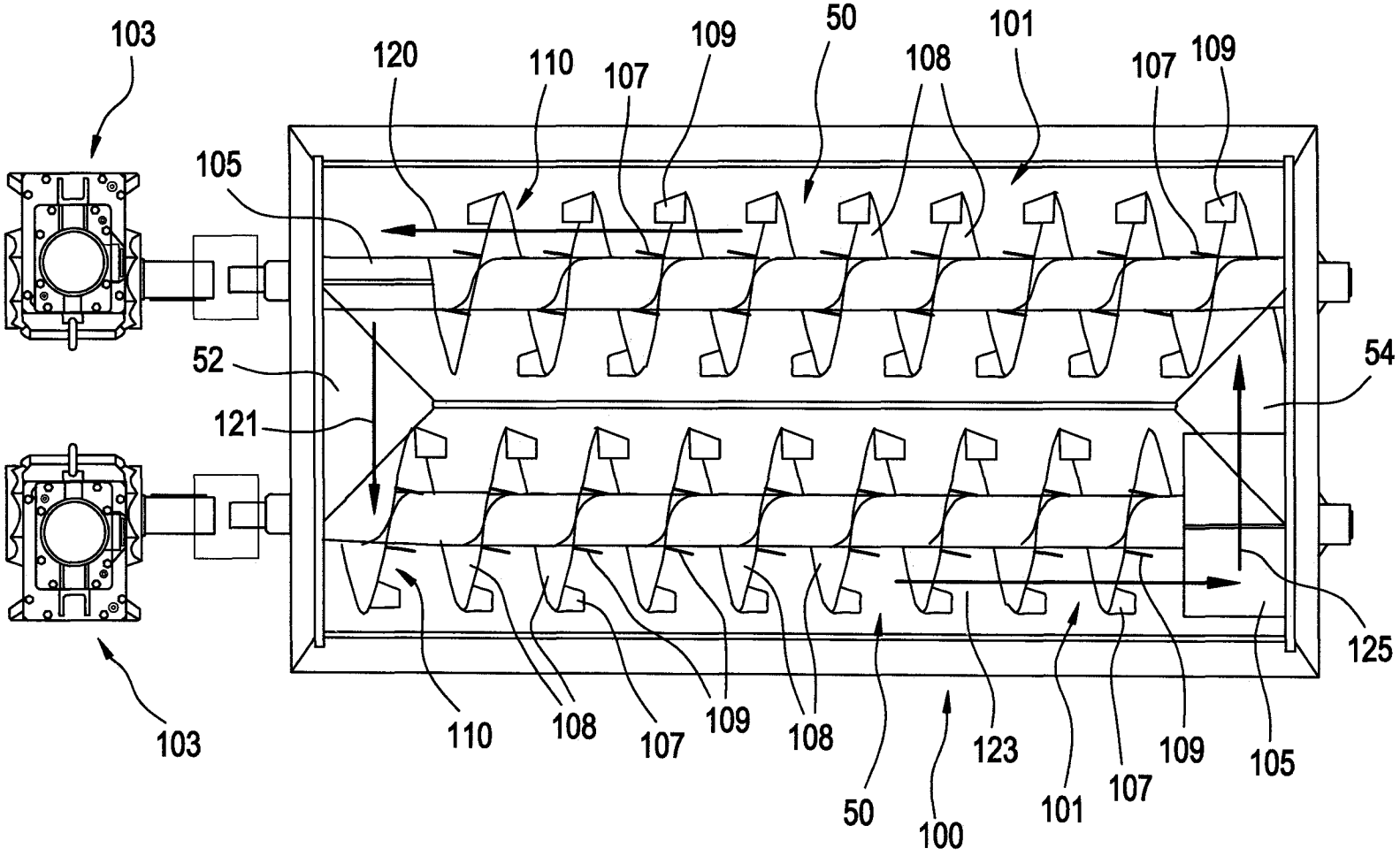
FIG. 7 shows a top view of a configuration in which twin augers are provided.
Figure 8:
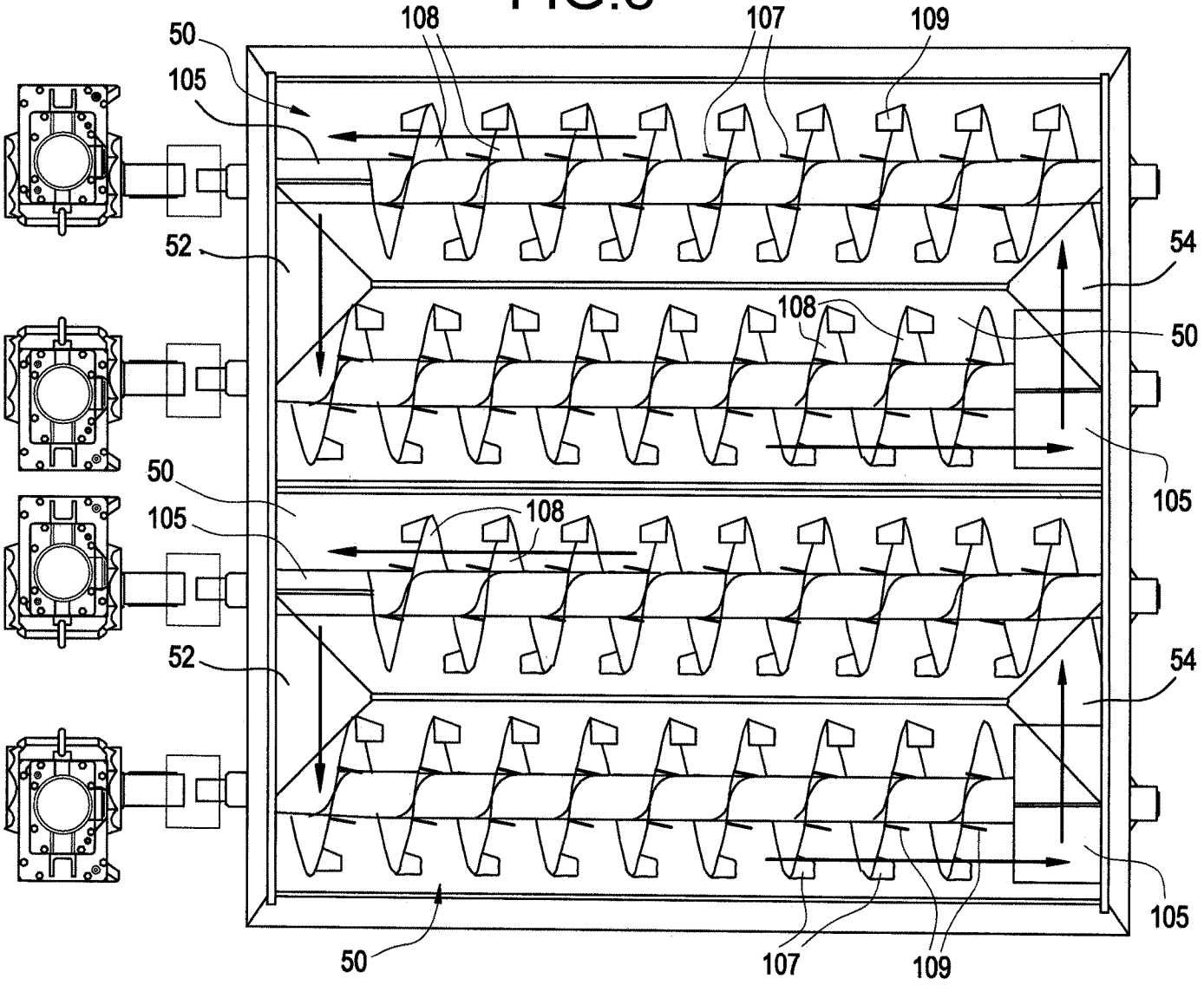
FIG. 8 shows a top view of a configuration in which quadruple augers are provided.
Figure 10:
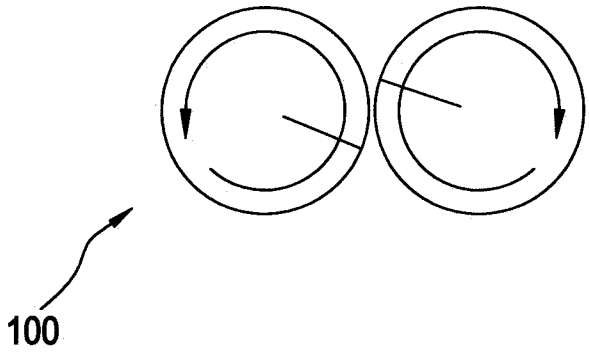
FIG. 10 shows an end view showing the directions of rotation of twin augers.

Reference is now made to FIGS. 7 and 8 which show configurations of two and four augers, respectively. With reference first to FIG. 7, a first configuration of the auger assemblies is generally designated by the reference numeral 100 and includes a mixing chamber with first and second subchambers 50 also shown in FIG. 3, and first and second augers 101 that are driven by motors 103. The motors 103 turn the augers 101 in opposite directions as shown in FIG. 10. Each auger 101 includes three types of paddles which are designated by the reference numerals 105, 107 and 109. The augers also include helical surfaces 108, 110 which act to convey asphalt being mixed along the length of each auger in a direction determined by the direction of rotation of each motor 103. Each subchamber 50 has first and second ends with the first ends adjacent one another and the second ends adjacent one another.

Figure 11:
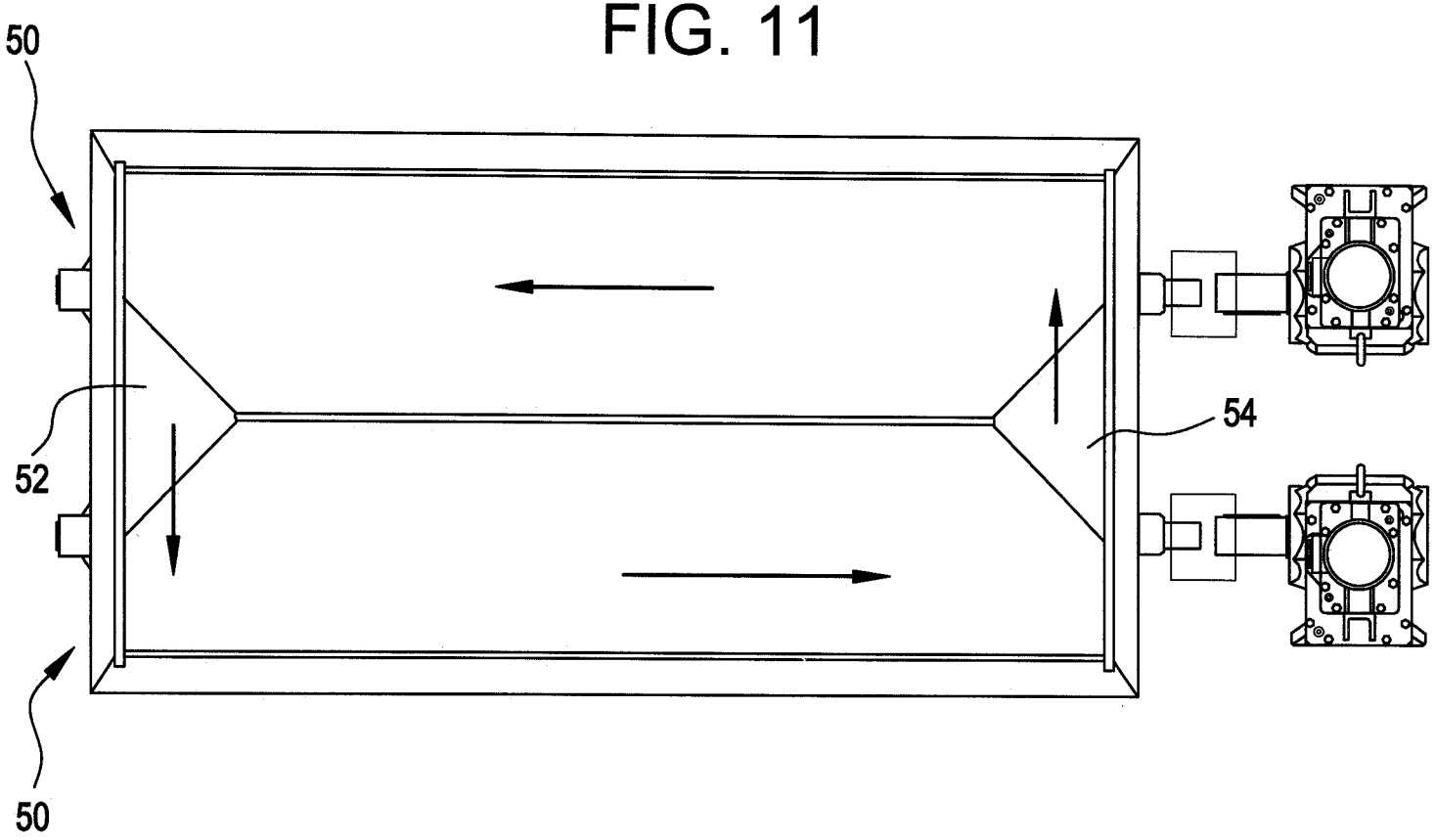
FIG. 11 shows a schematic representation of twin augers showing the direction of flow of recycled asphalt being mixed prior to application on a road surface.

As shown in FIG. 11, the flow of recycled asphalt material through the two augers is down one auger, across to the second auger, back down the second auger, across to the first-mentioned auger, and around and around for a time period with heat applied until the recycled material is thoroughly mixed and ready to be applied.

With reference back to FIG. 7, as explained earlier, there are three types of paddles on each auger 101. The transfer paddles 105 are found in the view of FIG. 7 at the left hand end of the upper auger 101 and at the right hand end of the lower auger 101. As seen in FIG. 7, first and second openings 52 and 54 are formed at the first and second ends, respectively, of the subchambers 50 to allow asphalt to traverse from one subchamber to the adjacent subchamber as the augers are rotated in opposite directions. Thus, as shown in FIG. 7, the transfer paddle 105 at the left hand side of the figure tends to transfer asphalt traveling in the direction of the arrow 120 in the direction of the arrow 121 through the opening 52 and toward the lower subchamber 50 in the view of FIG. 7. Then, through rotation of the auger 101 at the bottom of FIG. 7, the asphalt material is moved in the direction of the arrow 123 and then the transfer paddle 105 at the lower right of FIG. 7 transfers the asphalt in the direction of the arrow 125 through the opening 54 and into the subchamber 50 shown at the upper portion of FIG. 7. Around and around the asphalt travels until it has been thoroughly mixed and is ready for application to a pavement surface. As seen in FIGS. 3, 4 and 7, the inner walls of the subchambers 50 closely surround the peripheries of the augers 101 to facilitate movement of paving material along each auger as they rotate.

With further reference to FIG. 7, the sizing paddles are designated by the reference numeral 107 and are specifically designed to break up the multiple aggregate pieces into singular aggregate size. As clearly seen in FIG. 7, each turn of the auger includes a plurality of the sizing paddles 107 at the periphery of the helical surfaces 108. No two paddles are in line with each other, as they are all staggered. What is meant by the breaking up of multiple aggregate pieces is that when asphalt pavement is being recycled, it is typically found to be in plural clumps of material having multiple aggregate pieces attached together by the alphatene and maltene material. For most effective repaving, these large pieces must be broken up so that individual pieces of aggregate are separated from one another. Applicant has found that the sizing paddles 107 do a great job of performing this function.

Additionally, each turn of each auger 101 includes at least a pair of tumbling paddles 109. The tumbling paddles 109 are provided close to the axis of rotation of each auger 101 to push the recycling asphalt material into and out of the upper reaches of the subchambers 50, best described as the higher temperature heat zone, and into other material to create greater interaction of mixing and blending within the subchambers 50. In the preferred embodiment, per 360° rotation of an auger 101, there are seven total sizing paddles tumbling paddles, typically four of one of them and three of the other, all staggered with respect to one another so that none of them are aligned with one another.

Applicant is unaware of any other mixing auger system in the marketplace or ever devised which includes screw augers provided with transfer paddles, sizing paddles, and tumbling paddles as disclosed herein. These structures are at the heart of the present invention and ensure that once the pavement to be recycled has traversed the augers a number of times, the asphalt recycled material is thoroughly mixed and can be smoothly applied on a road surface as pavement without any inconsistencies, bumps, irregularities, or other abnormalities that would preclude a proper repaving job.

Figure 9:
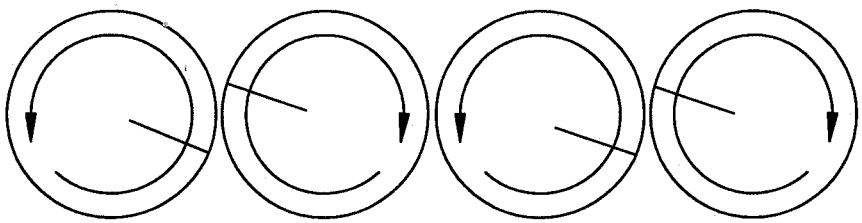
FIG. 9 shows an end view showing the directions of rotation of quadruple augers.

FIG. 8 shows the situation in which four augers and four subchambers are provided. The configuration of FIG. 8 allows treatment of a higher volume of recycled asphalt during the same time period in which a lower volume of recycled asphalt can be treated with the pair of augers shown in FIG. 7. As shown in FIG. 8, the four augers are provided in two pairs. FIG. 9 shows the directions of rotation of the pairs of augers. Each auger is provided with the transfer paddles 105, the sizing paddles 107, and the tumbling paddles 109. Each pair of subchambers 50 includes the openings 52, 54 to allow the recycled asphalt material to travel around and around from one auger to the next until thorough mixing and consistency have occurred.

Figure 12:
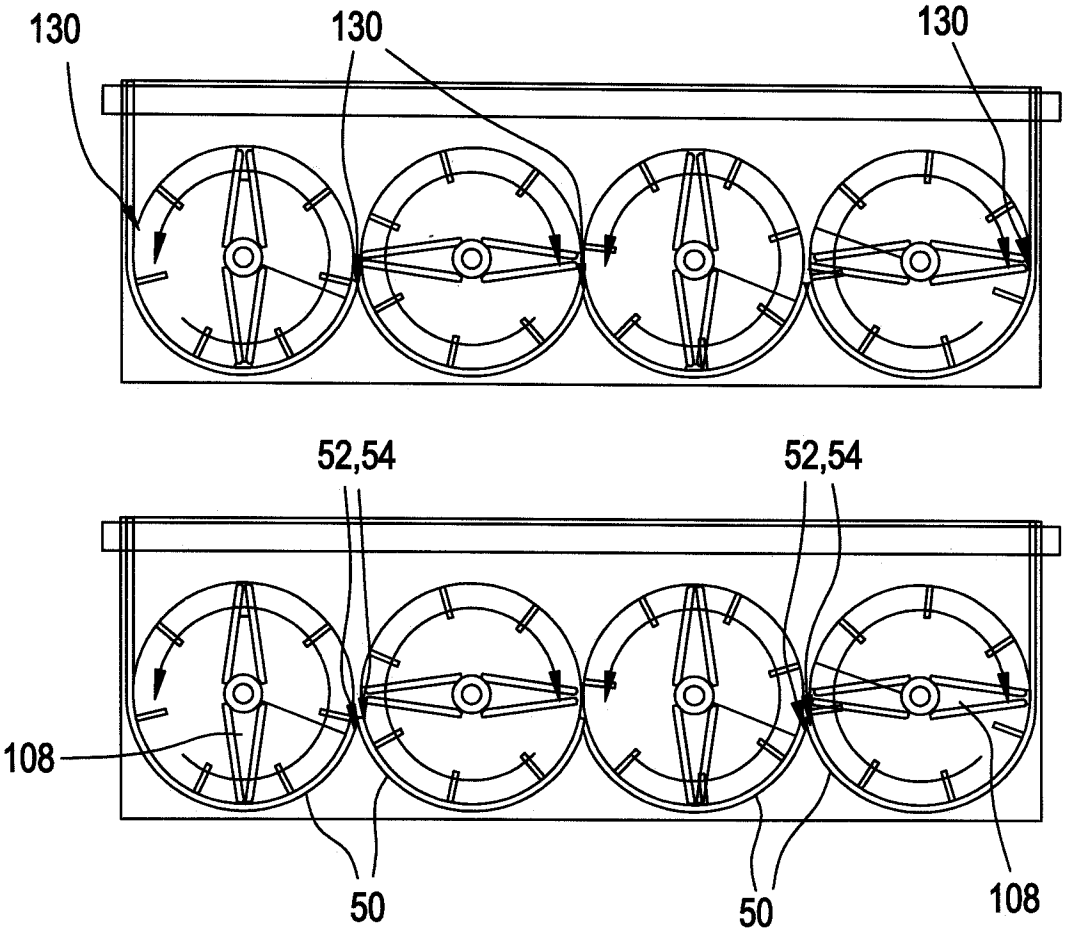
FIG. 12 shows a detailed end view of quadruple augers showing the material sizing zones and material transfer zones between augers.

With reference to FIGS. 7 and 8, the helical surfaces of the augers 101 are designated by the reference numeral 108. With reference to FIG. 12, the material transfer zones 52, 54 are shown between adjacent subchambers 50, although there is no transfer zone between the middle two subchambers 50 since the mixing occurs in pairs of augers. FIG. 12 also shows the material sizing zones designated by the reference numeral 130 which are defined by the sizing paddles 107 located at the outer periphery of the helical surfaces 108 of the augers 101 as best seen in FIGS. 7 and 8.

The apparatus 1 operates in the following manner.

The combustion air blower 38 provides air to the furnace body. From there it is distributed equally to the heaters 35 and the pilots. The gas comes through the piping from the tanks 19 past the regulators to the heaters 35. The heaters are where the gas-air mixture is set, and combustion takes place in the chamber spiraling out from the burner heads.

This creates a negative pressure directly under the burner heads 67 and any emissions and/or recirculating airflow are drawn back to the low-pressure center of each burner where they may become entrained with the combustion and since the combustion is taking place with excess air, the oxygen is available to burn off the carbon created in any overheating heating the asphalt. This makes for fewer emissions.

As designed, the flames hug tight to the bottom of the furnace where they radiate energy down into the mixture being recycled.

The radiant energy as well as the heated air turbulence inside the chamber heat the asphalt being recycled. The augers 101 turn very slowly, under 10 rpm, as they move the material in and out of the heat. The augers themselves get hot as does the chamber and that also radiates energy into the mixture. The pushing of the heated mix down into the mixture helps to distribute the energy through the pavement evenly. Preheating of the chamber before first batch also helps the heating after the first batch the chamber is up to temperature.

The augers are all the same. The difference is in the direction they are installed and rotation. They are installed in pairs pushing up where they meet in the middle and down on the outside. This brings the colder material into the heat and distributes the heated material into the mix.

The sizing paddles 107 break down the chunks being recycled against the chamber walls on the downward rotation. Every other paddle is a sizing paddle, and all paddles are staggered from each other. This limits the force required to turn the augers while sizing the material. Both sizing 107 and tumbling 109 paddles have tumbling function. The tumbling paddles 109 allow the material to escape laterally when trapped against the outside lowering overall force required in rotation of the augers.

The byproducts of the combustion exit through the flue 69 and are slowed by the diverter plates and the exhaust flow adjustment. Fresh air is entrained into the exhaust as it is exiting. This simple addition tends to clean up the combustion byproducts on their exit.

The inventive apparatus is designed to be fuel efficient to emit low pollution levels to efficiently and smoothly mix recycled asphalt and dispense it onto a road surface. Part of the process involves restoring the recycled asphalt, also known as bitumen.

Figure 15:
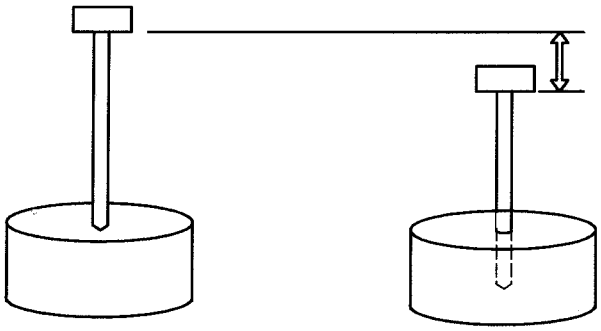
FIG. 15 shows a schematic representation of devices employed to conduct a bitumen penetration test.
Figure 16:
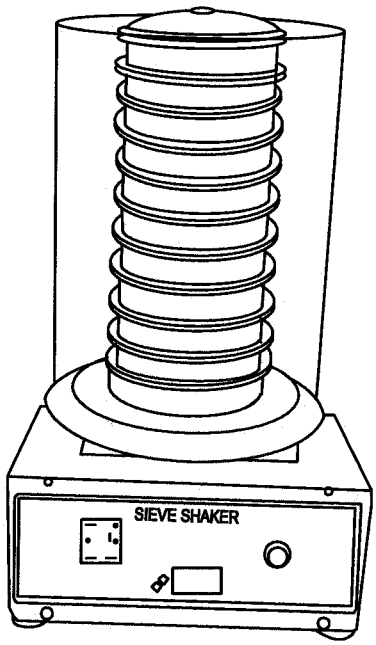
FIG. 16 shows a sieve shaker with a plurality of stacked sieves installed thereon for the purpose of determining the sizes of aggregate in a mixture of aggregate.

The bitumen is restored in a multi-step process:

1. Testing takes place to determine the proper amount and type of rejuvenator and other components to add to the mix. The testing can include employing a bitumen penetration test using components shown in FIG. 15. Simply put, a needle is penetrated into a sample of the existing asphalt. The deeper the needle penetrates into the sample using a fixed force, the more pliable the sample is found to be. This data helps determine the deficiency of maltenes in the sample. The testing may also include placing separated aggregate from a sample of the pavement at the top of a plurality of sieves as shown in FIG. 16. The sieves are stacked with the one with the largest diameter openings at the top and the openings becoming smaller as successive sieves are lower in the stack. The sieves are then shaken using a sieve shaker and aggregate of differing sizes travels downward through the sieves. When this process is completed, the proportions of aggregate of differing sizes may be determined and can be compared with the original formula when the pavement was originally placed. Any deficiencies in aggregate of various sizes can be adjusted to conform the pavement to be recycled to the original aggregate formula.

2. Mixing and heating of the existing material begins to allow the mixture to be broken down to single aggregate sizing or reasonably close, exposing all the bitumen to rejuvenator and for the existing bitumen to become liquified lowering the surface tension before the addition of the primary rejuvenator begins to allow for more complete blending.
3. The rejuvenator is added slowly to the mix while it is immediately kneaded into the mix by the augers 101.
   a. This slow addition and mixing allow for the bitumen to blend much faster to the primary rejuvenator by limiting the film thickness of the rejuvenator on the existing film thickness of bitumen allowing for penetration of the rejuvenator into the bitumen.
4. This is a fully controlled environment designed to maximize the blending of primary rejuvenator and existing bitumen in the recycled mix.
5. This mixing continues for the desired amount of time as chosen in the mix design testing. Typically, 5 minutes after the primary rejuvenator is added to the existing mixture the blending is complete. The blending is completed before additional product is added.
6. After the mixing is complete, the secondary product, emulsified asphalt bitumen, is added in the same way, slowly added while mixing to provide a uniform coating of new asphalt to the recycled material.
7. Additives of any type required can be added before, after or at both points of when the second product is added to the bitumen.

This method does a mix design for each type of mix that may be encountered. This process then gives one a choice for the condition of the mix to fine tune the processing variables to real world conditions of the existing pavement.

Each batch is weighed, allowing for the exact amount of each product to be added.

The existing asphalt is heated to a temperature that lowers the surface tension of the existing bitumen prior to adding the additives. The additives are added separately and slowly while mixing thoroughly under continued heating so that homogenous bitumen can be created and restored to as new condition.

No new emulsified asphalt bitumen is added until all the rejuvenator has been incorporated into the existing bitumen.

The new bitumen is simply a veneer of new product on top of the fully recycled product.

Preferred Steps of the Pavement Recycling Process:

The recycling operation may require additional pavement material, (millings) be added to the mix. Most often 10% or so of millings will be incorporated in every batch. Addition of 10% in stock millings to Applicant's mix design is standard to make up for the voids, (potholes) in the mix being recycled. The preferred steps:

1. Determine the area to be recycled and repaired.
2. Obtain a random sampling for testing of the existing mix type from the repair area approximately 150 lbs. consisting of a plurality of raw material samples each approximately 12" square.
3. Take samples to Laboratory and run 3 batches, a total of 9 pills 3 of each, (a pill is common term for the pounded-out sample it resembles a large pill or hockey puck when done).
4. The samples undergo a modified version of the Marshall Mix Design Method well known to those skilled in the art, testing for:
   a. Marshall Stability
   b. Marshall Flow.
5. This is done by heating the samples to about 250° F.
6. Dislodging, breaking and combining the sample material to into one homogenous mix.
7. Mixing the sample by hand in a bowl.
8. Packing a sample into a Marshall Hammer and pounding a pill.
   a. 75 Blows each side is the standard used.
   b. It is recommended that 3 pills be made at each point including baseline.
9. Following a modified version of the Marshall Mix Design Practice, the modifications are:
   a. The gradation is what the raw material gives you, no VMA and VFA, (voids filled with asphalt) testing will be performed.
      i. The given here is that one can obtain passing results on stability and flow with existing material; if not, some mix should not be recycled without the modification.
         1. These mixes requiring modification should be used as base or berm material as is.
         2. They can be recycled but no need to incur extra expense and work, where less than 5% of the material requires modifications.
   b. Mix will be heated, mixed, and compacted at 250° F.
   c. Compaction will always be 75 blows each side.
10. The first sample or baseline is the existing material as-is nothing added.
11. Typical baseline test of existing material will result in a mixture having high stability and low flow, it will not pass the Marshall standard requirements.
    a. Existing Mix has lost its lighter oils and, as a result, its elasticity.
    b. The strength or stability of the mix has not been eroded over time; it tends to get even stronger and there is no requirement preventing a mix from being too strong.
    c. The flexibility has been eroded resulting in cracking and that shows up in testing as a low flow result.
       i. The material will break rather than stretch, like an old rubber band. This is the problem.
12. The two rejuvenated samples shall contain 0.3% and 0.6% rejuvenator by weight of mix.
    a. Rejuvenator is a common product available by other vendors as well as AARS, INC.
    b. When the rejuvenator is added to the mix it must be added slowly to heated material and mixed by hand for 10 additional minutes while maintaining heat once adding and mixing is complete assuring homogenous material, as much as possible and simulating the apparatus processing.
       i. This is where we are adding liquid to affect that coating or film thickness of about 1/10 of a sheet of copy paper. Distribution and manipulation of the rejuvenator is of great importance to achieving a homogenous product.

c. The first rejuvenated sample is made from existing material plus 0.3% rejuvenator added by weight of mix.

d. The second rejuvenated sample is made from existing material plus 0.6% rejuvenator added by weight of mix.

i. For Example, a 10,000-gram sample would have 30 grams and 60 grams of rejuvenator respectively.

ii. If the rejuvenator is an emulsion, the percentage of solids is important to know since it is the solid percentage that must be added. Rejuvenating emulsion with 62% solids would require adding 48.4 grams and 96.8 grams to accurately test the materials.

1. Emulsions have an advantage in the rejuvenation in that they already break down the particle size of the rejuvenator so emulsions better blend with the existing bitumen.

a. The disadvantage is the cost is higher and one is handling 38% water and adding water to the mix is not desired:

i. The heating time required is increased to drive the water out;

ii. The steam tends prohibit the homogenous blending.

2. Emulsified or straight oil rejuvenator have no advantage in this process besides cost, and this process is designed more towards using straight oil.

e. Pound new Marshall pills from these samples so now one will have 9 pills from three different ranges of rejuvenation.

13. Run a stability and flow test on these rejuvenated samples.

14. Chart all 9 of these samples' stability vs rejuvenator percentage.

15. Extrapolate the average of these results into a chart and find the rate of application that allows for mix to pass the Marshall standards of new Hot Mix Asphalt (HMA) pavements.

a. Our suggested standards are:

i. Stability≥1500 pounds;

ii. Flow 0.08"≤0.16"

b. Once standards are met add emulsified asphalt cement in the amount of ½ the application rate of rejuvenator application rate.

i. This provides a fresh veneer of new surface bitumen to extend the life of the recycled product.

c. This is added by mixing the rejuvenator into the mix for 5 additional minutes after application then adding the emulsified asphalt slowly and mixing for 5 additional minutes.

d. Run one last test to assure fully recycled mix meets standards. If not, adjust accordingly until mix passes the standards.

i. If flow is high, mix is too soft or deforming to easily—cut back on rejuvenator only—increase mixing time, (this is programmable behind the password in the apparatus);

ii. If flow is low, mix is too hard, no flexibility—increase the rejuvenator and decrease the emulsified asphalt accordingly;

iii. Low stability or mix is too weak should never be a problem unless the mix is problematic and should not be recycled.

16. Now the amount of product to be added to the mix is known.

17. Enter the ratio of each additive into the control panel of the apparatus in gallons per 1000 pounds of mix.

a. This is the Job Mix Formula for this type of mix, store under an appropriate name for future use.

b. In some very rare instances, you may be required to enter the mix time and/or final mix temperature. This can all be done behind the password of the apparatus.

i. Once the data is stored, it is always available for future use.

ii. Many users recycle from a central storage of millings location, and truck the recycled asphalt to the job site. In this example, this testing is only required once.

1. It is recommended to verify periodically, at minimum, 3 or 4 times yearly.

18. The apparatus 1 is transported to the repair location and started.

19. Select the job mix formula by name it is stored under.

20. The apparatus is then leveled to provide uniform processing and facilitate the function of weighing the batch.

a. The 3 jacks 2; left rear, right rear and front are adjusted; the digital leveling gauge is on the operator's dash.

21. Jack Hammer is plugged in and used to separate the damaged area from the existing roadway cleanly leaving a uniform edge to make the repair.

22. Material is then removed; a few ways are possible to do this function:

a. Higher productivity is achieved by using a small milling machine attachment and a skid steer loader to grind out the material using the jack hammer to only trim out the repair location properly forming a vertical edge.

b. Material can also be scooped out with a loader or skid steer.

i. Material can be sized right on location with the optional crusher attachment for even higher productivity.

c. Standard is the removal of the roadway in small 6" to 8" chunks by jack hammer.

d. Using millings from a central storage location are a common possibility.

i. When the central milling supply is the source of raw material, the on-site material has been removed already and combined with other material to form the central location stockpile.

23. Now that the all the asphalt pavement material is removed from the repair location, the base is exposed in the repair area. The base should be examined, even proof rolled, to assure it is sound so the repair will last properly. Once repairs are made, if necessary, the base is graded level and compacted to establish a firm base for the repair.

a. Any areas of the base needing repair are defined and treated appropriately.

b. Deep problems can be dug out to the depth required for a sound base to be established and filled and compacted with millings.

c. Base is restored then compacted flat and true to accept full recycled pavement repair.

d. Base and edges of the pavement are then tack coated with emulsified asphalt cement to establish a bond from roadway to subbase.

While steps 20-22 above are taking place at repair site, the apparatus also undergoes the following . . .

24. Furnace is lifted open.
25. An option of preheating the mixing chamber exists for the first batch processed daily.
26. Tare weight is taken.
27. The chamber is loaded with the existing removed material and/or additional millings.
28. Gross weight is taken, and the apparatus automatically calculates the net processing batch weight.
29. Job mix formula is selected on the touch screen now.
30. Quality or Condition of existing material in the batch is selected on the dial:
    a. Normal for normal or average condition material.
    b. Dirty for dirty or overly oxidized material.
    c. Clean for exceptional material, low level of oxidation or no contaminates or dirt.
        i. This fine tunes the additives automatically and processing by the preprogramed modifications of more or less of each additive and can be adjusted behind the password.
        ii. This process tests for the material and sets the processing parameters of the recycling based on those results then allows fine deviation based on visual variance from the normal if necessary.
31. Furnace is partially lowered and then ignited once ignition has taken place the furnace is further lowered to mixing chamber sealing with high temperature combustion gasket.
    a. Furnace is constantly monitored by flame safety system automatically.
32. The augers are switched on starting the automatic processing.
    a. Mixing and mix temperature is constantly monitored throughout.
33. Material is heated and continuously mixed for a preprogrammed amount of time approximately 5 minutes bringing it to starting treatment temperature, temperature where existing bitumen has liquified so that forced blending of rejuvenator and existing bitumen can take place.
34. Based upon the mix type and quality selection the exact amount of the primary rejuvenator, (product A) is added directly to the old material for true recycling the direct restoration of the existing bitumen to take place.
    a. This direct kneading under heated conditions allows for maximum absorption of rejuvenator into the film thickness of bitumen on the surface of the aggregates.
35. Mixing and heating continues for an additional 5 minutes after the rejuvenator addition is complete.
36. The emulsified asphalt cement, (product B) is added to the exact amount required while mixing and heating continues.
37. Once the heating reaches the desired mix temperature as set by the job mix formula, then the horn is activated alerting the operator that mix is complete.
    a. Typical batch processing time is approximately 20 minutes.
    b. (If for some reason the operator is not watching the machine, the machine will shut off the furnace automatically at 300° F. sounding continuous alarms until reset.)
38. Once complete, furnace is shut off and auger mixing is stopped.
39. Tail gate is unlocked.
40. Discharge is selected and the mix begins to pour out of the mixing chamber at the rear of the machine as controlled by the discharging augers.
41. Once most of the mix is emptied the furnace is then lifted full open.
42. The mixing chamber is lifted to fully remove all processed material.
43. Once the mixing chamber is completely empty, the mixing chamber is lowered.
44. Recycled material is distributed by hand as soon as it is available, leveled, and compacted in place.
45. Tail gate is locked, and the apparatus is ready for the next batch.

Figure 17A:
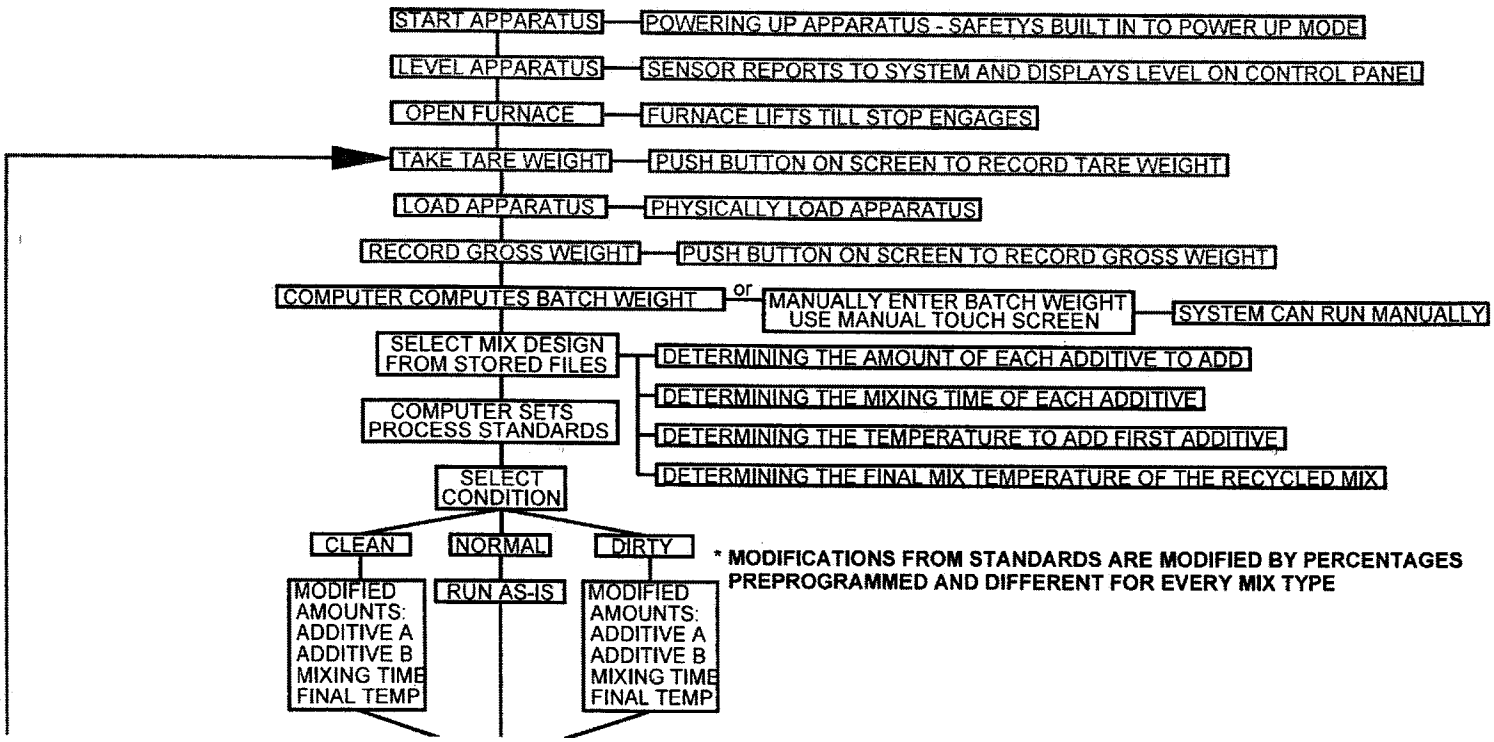
FIGS. 17A, 17B, and 17C combine to show a flowchart explaining the sequence of operation of the inventive apparatus and process of its use.
Figure 17B:
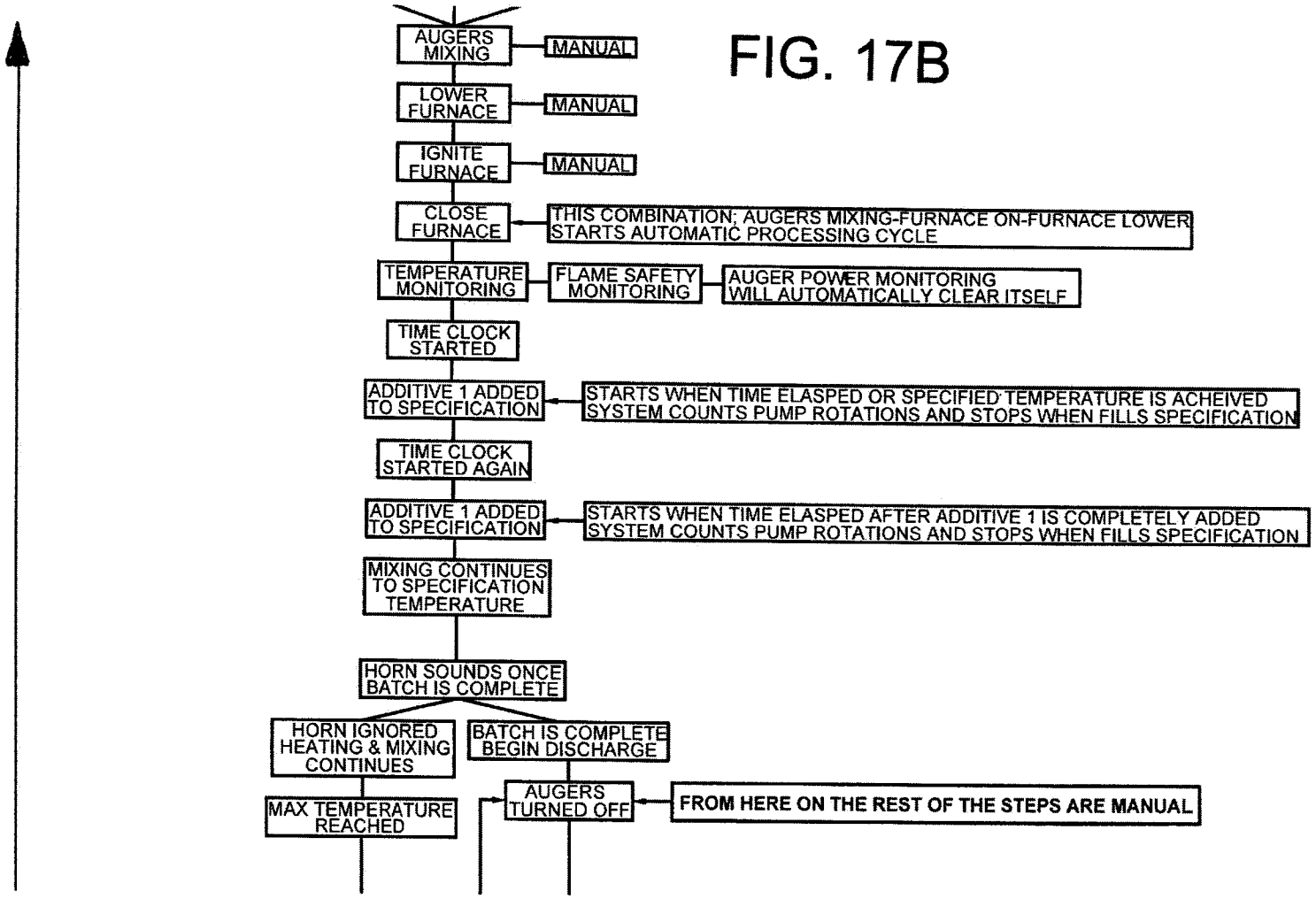
Figure 17C:
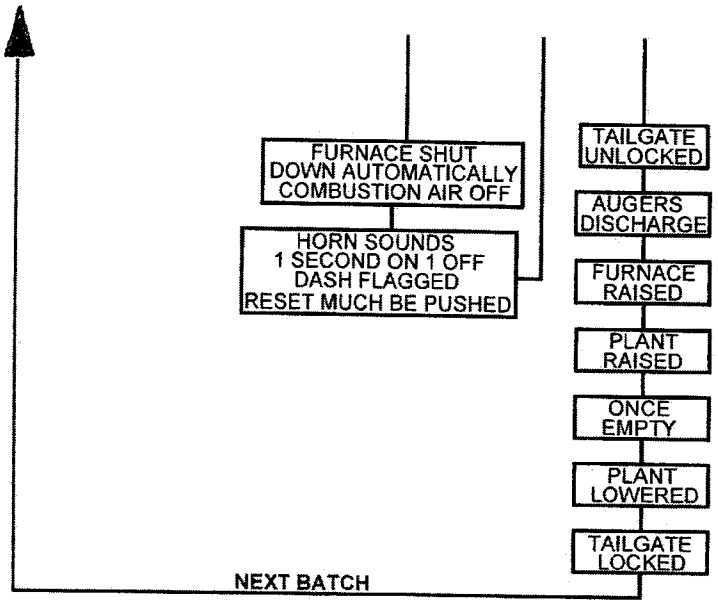

FIG. 17 is a flowchart showing the computerized electronic operation of the inventive apparatus 1. FIG. 17 shows pre-computer functions, computer functions, and manual steps after the computerized functions have taken place.

The steps shown in FIG. 17 speak for themselves and explain, logically, how a batch is weighed, heated, mixed, monitored, mixing is completed, and the batch is dispensed onto a road surface whereupon the next batch is prepared and processed. As explained supra, the present invention including the apparatus and the method of operation provides a significant advance over the prior art and will allow a contractor to accurately analyze an existing pavement, mix the existing pavement with chemicals which will restore the pavement material to its original formula and then dispense it onto a road surface for accurate repaving.

Accordingly, an invention has been disclosed in terms of preferred embodiments thereof, which fulfill each and every one of the objects of the invention as set forth hereinabove, and provide a new and useful mobile asphalt recycling apparatus and method of using of great novelty and utility.

Of course, various changes, modifications, and alterations in the teachings of the present invention may be contemplated by those skilled in the art without departing from the intended spirit and scope thereof.

As such, it is intended that the present invention only be limited by the terms of the appended claims.

The invention claimed is:

1. An apparatus for paving a road surface comprising:

a) a housing on which are mounted:
    i) a furnace and a fuel supply for said furnace;
    ii) a mixing chamber configured to receive a paving material, mix said paving material and dispense said paving material onto said road surface;

b) said mixing chamber including:
    i) a first subchamber and a second subchamber;
    ii) said subchambers being adjacent one another;
    iii) said subchambers having first ends adjacent one another and second ends adjacent one another;
    iv) a first opening interconnecting said first ends and a second opening interconnecting said second ends;
    v) a first auger rotatably mounted within said first subchamber and a second auger rotatably mounted within said second subchamber;
    vi) said augers having helical surfaces whereby when they are rotated, paving material is conveyed along a length of each auger;

c) said first auger being rotatable in a first direction and said second auger being rotatable in a second opposite direction;

d) said first auger having a first transfer paddle adjacent said first opening and said second auger having a second transfer paddle adjacent said second opening;

e) whereby when said augers are rotated to mix said paving material, said first auger rotates in a direction moving said paving material toward said first opening and said second auger moving said paving material toward said second opening, said first transfer paddle moving said paving material from said first subchamber, through said first opening and into said second subchamber, said second transfer paddle moving said paving material from said second subchamber through said second opening and into said first subchamber, whereby said paving material circulates between said first and second subchambers while said augers rotate and mix said paving material.

2. The apparatus of claim 1, wherein said housing comprises a trailer.

3. The apparatus of claim 1, wherein said fuel supply comprises a container of propane gas.

4. The apparatus of claim 1, wherein said subchambers have inner walls closely spaced about said augers.

5. The apparatus of claim 1, wherein each auger further includes a plurality of staggered sizing paddles configured to break up multiple aggregate pieces within said paving material into single aggregate size.

6. The apparatus of claim 5, wherein each said auger further includes a plurality of tumbling paddles configured to push paving material into and out of upper reaches of said subchambers.

7. The apparatus of claim 5, wherein said sizing paddles are located at peripheral locations on said helical surfaces.

8. The apparatus of claim 6, wherein said tumbling paddles are located adjacent an axis of rotation of each auger.

9. The apparatus of claim 1, wherein each said auger further includes a plurality of tumbling paddles configured to push paving material into and out of upper reaches of said subchambers.

10. The apparatus of claim 9, wherein said tumbling paddles are located adjacent an axis of rotation of each auger.

11. The apparatus of claim 1, wherein said paving material comprises recycled asphalt.

12. The apparatus of claim 2, said furnace further including a plurality of burners and a combustion air blower for supplying air under pressure to said burners.

13. The apparatus of claim 1, wherein each said auger is rotated by a motor coupled thereto.

14. The apparatus of claim 2, wherein said trailer includes a plurality of extendable jacks to support said trailer at a location of use.

15. The apparatus of claim 2, wherein a plurality of tires support said trailer for transport.

16. The apparatus of claim 11, further including a first tank on said housing containing an asphalt rejuvenating chemical for mixing with said asphalt and a second tank on said housing containing fresh asphalt cement for mixing with said asphalt.

17. The apparatus of claim 2, wherein said furnace is pivotably mounted on said trailer such that said furnace may be pivoted to expose an upper opening of said mixing chamber to facilitate loading a quantity of paving material into said mixing chamber, and said mixing chamber is pivotably mounted on said trailer so that said mixing chamber may be pivoted to open a tailgate and dump an entire load of paving material onto a road surface, said augers being both operable in a same direction to move said paving material toward said tailgate to facilitate dumping said entire load.

18. An apparatus for paving a road surface comprising:

a) a trailer on which are mounted:

i) a furnace and a fuel supply for said furnace;

ii) a mixing chamber configured to receive a paving material, mix said paving material and dispense said paving material onto said road surface;

b) said mixing chamber including:

i) a first subchamber and a second subchamber;

ii) said subchambers being adjacent one another;

iii) said subchambers having first ends adjacent one another and second ends adjacent one another;

iv) a first opening interconnecting said first ends and a second opening interconnecting said second ends;

v) a first auger rotatably mounted within said first subchamber and a second auger rotatably mounted within said second subchamber;

vi) said augers having helical surfaces whereby when they are rotated, paving material is conveyed along a length of each auger;

vii) said subchambers having inner walls closely spaced about said augers;

c) said first auger being rotatable in a first direction and said second auger being rotatable in a second opposite direction;

d) said first auger having a first transfer paddle adjacent said first opening and said second auger having a second transfer paddle adjacent said second opening;

e) whereby when said augers are rotated, said first auger rotates in a direction moving said paving material toward said first opening and said second auger moving said paving material toward said second opening, said first transfer paddle moving said paving material from said first subchamber, through said first opening and into said second subchamber, said second transfer paddle moving said paving material from said second subchamber through said second opening and into said first subchamber, whereby said paving material circulates between said first and second subchambers while said augers rotate and mix said paving material.

19. The apparatus of claim 18, wherein each auger further includes a plurality of staggered sizing paddles configured to break up multiple aggregate pieces within said paving material into single aggregate size and a plurality of tumbling paddles configured to push paving material into and out of upper reaches of said subchambers.

20. The apparatus of claim 18, wherein said first subchamber and second subchamber comprise a first pair of subchambers, said mixing chamber further including a second pair of subchambers comprising third and fourth subchambers each containing a rotatable auger.

* * * * *